United States Patent [19]

Steidinger

[11] 4,375,382

[45] Mar. 1, 1983

[54] METHOD OF MAKING A CONTINUOUS WEB FORM AND PRODUCT, PARTICULARLY ONE SUITABLE FOR AIRLINE TICKETING

[75] Inventor: Donald J. Steidinger, Barrington, Ill.

[73] Assignee: Wallace Computer Services, Inc., Hillside, Ill.

[21] Appl. No.: 299,041

[22] Filed: Sep. 3, 1981

Related U.S. Application Data

[60] Division of Ser. No. 98,992, Nov. 30, 1979, Pat. No. 4,311,325, Continuation-in-part of Ser. No. 914,381, Jun. 12, 1978, Pat. No. 4,208,066, Continuation-in-part of Ser. No. 483,952, Jun. 28, 1974, Pat. No. 4,109,936, Continuation-in-part of Ser. No. 453,556, Mar. 21, 1974, abandoned, which is a continuation of Ser. No. 374,274, Jun. 27, 1973, abandoned.

[51] Int. Cl.[3] ..... B41L 1/22; B41L 1/26

[52] U.S. Cl. ..... 156/265; 156/290; 229/69; 282/11.5 A

[58] Field of Search ..... 282/11.5 R, 11.5 A, 282/12 R, 12 A; 270/53; 229/69; 156/290, 291, 264, 265, 552, 562

[56] References Cited

U.S. PATENT DOCUMENTS

| | | | |
|---|---|---|---|
| 2,108,462 | 2/1938 | Wiswall | 282/11.5 R |
| 2,118,655 | 5/1930 | Phillips et al. | 282/11.5 A |
| 3,077,728 | 4/1975 | Hery | 282/11.5 A |
| 4,109,936 | 8/1978 | Steidinger | 272/11.5 A |
| 4,200,066 | 6/1980 | Steidinger | 282/11.5 A |

*Primary Examiner*—David A. Simmons

*Attorney, Agent, or Firm*—Tilton, Fallon, Lungmus & Chestnut

[57] ABSTRACT

A method and form suitable for airline ticketing wherein interior plies are transversely cut while the exterior plies are only weakened so that advantageously handleable ticket assembly is readily developed by removing the top ply and a portion of the bottom ply to yield a ticket packet.

9 Claims, 10 Drawing Figures

METHOD OF MAKING A CONTINUOUS WEB FORM AND PRODUCT, PARTICULARLY ONE SUITABLE FOR AIRLINE TICKETING

This is a division of application Ser. No. 098,992, filed Nov. 30, 1979, now U.S. Pat. No. 4,311,325 which is a continuation-in-part of my co-pending application Ser. No. 914,381 filed June 12, 1978, now U.S. Pat. No. 4,208,066 which in turn was a continuation-in-part of Ser. No. 483,952, filed June 28, 1974, now U.S. Pat. No. 4,109,936, that application in turn was a continuation-in-part of co-pending application Ser. No. 453,556, filed Mar. 21, 1974 now abandoned; that case being a continuation of co-pending application Ser. No. 374,274, filed June 27, 1973, now abandoned.

BACKGROUND AND SUMMARY OF INVENTION

This invention relates to a method of making a continuous multiple web form and product, particularly one suitable for airline ticketing and, more especially, to a so-called "automated" ticket, i.e., one suitable for computer printing.

In the early 1970's, the airlines were considering computer printing of tickets. Almost every air traveler has, on occasion, had to wait while a ticket clerk laboriously filled in various numbers, names, etc. The project for developing an automated ticket was handled by the International Air Transport Association. The form of ticket specified for automation was that of Herz U.S. Pat. No. 3,877,728.

The Herz construction adopted by the IATA had generally the appearance of a business form—having control margins equipped with line holes for stepping the form through a computer printer. The continuous form was separable into individual ticket booklets by slitters in the computer printer which were used to remove the control margins at the same time the ticket was being printed—where upon the individual panels or tickets would automatically separate one from another because the slitting along the control margins would intersect transverse slits.

Although a number of problems characterize the Herz ticket, perhaps the most vexing problem involved buckling and wrinkling on the one hand or "tenting" on the other.

Buckling and wrinkling occur when the adhesive that fastens the continuous webs dries before the webs are folded. When this is the case, the outermost web of the fold has the longest path so those with shorter paths have no place to go (upon zig-zag folding) except to buckle. Then when a series of folds are introduced, the weight of the pack converts these buckles into wrinkles. Then, even on unfolding, the wrinkles are still there.

On the other hand, tenting occurs when the adhesive that fastens the continuous web dries after the webs are folded. However, upon unfolding, and when the glue is dried, the innermost web of the fold defines the form length and the outer webs having been shingled relative thereto, assume a "tent" configuration. These irregularities or distortions can, on occasion, jam the computer, interfere with optical scanning or otherwise interfere with what was hoped to be a mechanized operation.

According to the invention, as articulated in my prior application Ser. No. 483,952, filed June 28, 1974, now U.S. Pat. No. 4,109,936, at least one exterior ply has control margins which are continuous while the interior plies are narrower, i.e., lacking control margins, and are transversely severed to define discrete ticket booklets—as are the exterior ply or plies between control margins. This approach has been successful in avoiding the problems inherent in the use of the Herz ticket. However, with the advent of other computers, difficulties have arisen and which are solved by the instant invention.

When it is advantageous for the computer system to use a form where only one of the exterior plies can be wider or if neither exterior ply can be wider it is no longer possible to cut the interior plies into packets of cut sheets as is necessary to avoid the buckling and wrinkling or tenting problems characteristic of Herz. The free edges cause computer feeding problems.

Further, it is not possible to make the packets of cut sheets equal in length to the exterior plies and assemble them later to the carrier ply as this leaves no margin for small errors in length or positioning of the packets. Small errors will tend to accumulate and prevent successful folding of the tickets into a pack.

Others have tried to solve this need by attaching ticket packets made in one operation to a continuous carrier ply in a later operation. First attempts using tickets with one stub and loose ends gave computer feeding troubles due to the loose flapping ends.

Another attempt by others was to provide the ticket packet with a stub at each end and to fasten the packet to the continuous carrier in a later operation at both ends. This solved the feeding problem but required that the ticket agent remove one stub with up to 10 plies of paper from each ticket before it is presented to the customer. The second stub was also wasted paper, about 6% to the total form.

This invention teaches how the packet of cut tickets can be cut to exact length and positioned in register on the exterior carrier ply without accumulating errors so as to enable reliable refolding into a pack and avoid the buckling and wrinkling or tenting problems of continuous glued forms.

The invention further teaches how the cut sheet packets can be economically fabricated from continuous webs and be made shorter than the exterior carrier plies and also avoiding the buckling and wrinkling or tenting problems and maintain register of the cut packet with the exterior plies for accurate computer printing and reliable optical scanning of the redeemed tickets.

In either case the exterior plies are continuous and control the cut edges of the tickets so they do not cause computer feeding or refolding problems. They are weakened for convenient eventual separation of the printed ticket from the continuous series.

According to the instant invention, a plurality of webs are advanced toward a uniting station for union with another web which ultimately becomes one of the exterior plies of the form. Thus, the plurality of webs ultimately constitute the interior plies. Then, prior to the union with still another web which ultimately becomes the other exterior ply, the plurality of webs are transversely cut and the first mentioned single web is transversely weakened. Resulting therefrom is a uniquely contained packet lacking free edges or the buckling and wrinkling or tenting problems which could interfere with the smooth and trouble-free desired mechanized operation. The other exterior ply—which becomes the top ply, is secured only to the bottom ply intermediate lines of perforation in the latter so as to readily develop an advantageously handled ticket packet. Additionally, the invention provides continuous web forms in zig-zag folded condition wherein the interior plies terminate short of the transverse fold lines, thereby preventing the interior plies from entering into the fold zone of the exterior plies.

DETAILED DESCRIPTION

The invention is described in conjunction with the accompanying drawing, in which FIG. 1 is a fragmentary top plan view of a business form suitable for airline ticketing and which incorporates teachings of the invention;

Figure 1:
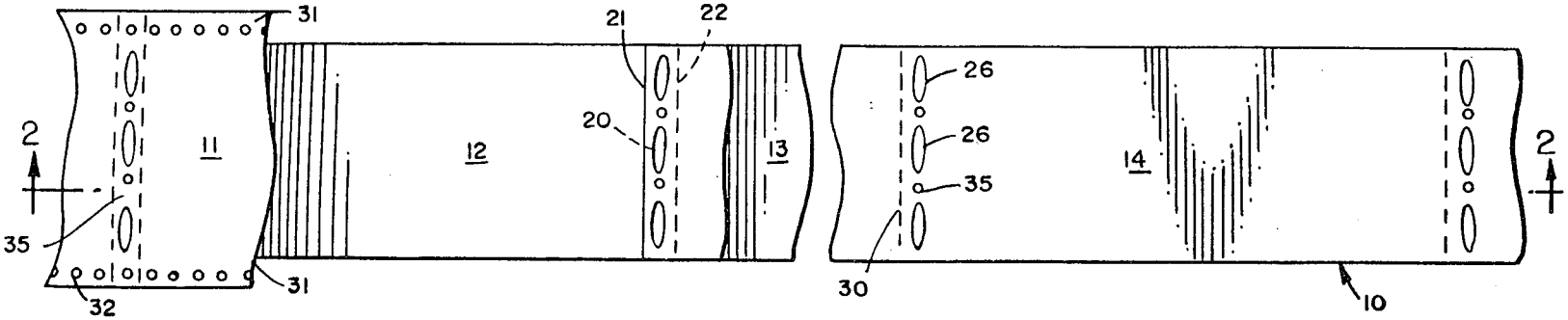

Referring first to FIG. 1, a business form which is an airline ticket which is designated 10 and includes a top ply or layer 11, a plurality of intermediate plies (two of which are illustrated at 12 and 13), and a bottom ply or layer 14.

Figure 4:
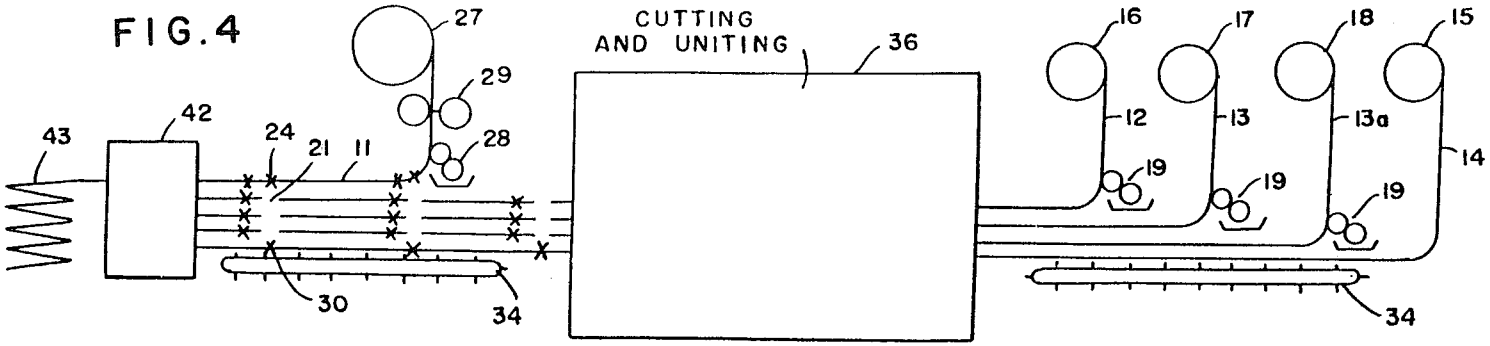
FIG. 4 is a side elevational view (generally schematic) of apparatus employed in the practice of the inventive method.

The method of manufacture can be appreciated from a consideration of FIG. 4. In that view and at the extreme upper right, a parent roll 15 is seen to provide a web 14 which, when incorporated into a business form such as an airline ticket, becomes the bottom ply 14 of FIG. 1. Also seen in the upper right hand portion of FIG. 4 are three other parent rolls 16, 17 and 18 which provide, respectively, webs 12, 13 and 13*a*, viz, the webs that ultimately become the interior plies of the form of FIGS. 1 and 2. It will be immediately appreciated that the number of intermediate plies can be varied substantially—depending upon the intended use of form. Many airline tickets have eight interior plies so as to provide an auditor's coupon, a number of flight coupons, credit card charge form, passenger's receipt, etc.

As seen in FIG. 4, the webs 12, 13, 13*a* ultimately constituting the interior plies are equipped with adhesive through adhesive units 19. More particularly, the adhesive is laid down in longitudinally spaced areas as at 20 in FIGS. 1 and 2. More particularly, the area of adhesive lay-down is the so-called stub portion of the ticket which can be seen to be defined between a line of severance 21 (see the central portion of FIG. 1) and a line of perforation 22. The stub area can also be appreciated from a consideration of the portion designated 23 at the extreme left hand portion of FIG. 2. There, it will be seen that the top ply 11 is equipped with a pair of lines of weakness or perforation as at 24 and 25. The stub portion lies between these two lines of weakness and the top ply 11 is adhered to the uppermost interior ply 12 by adhesive as at 26.

This can be appreciated from a consideration of the left hand portion of FIG. 4 wherein a parent roll 27 provides the web 11. Adhesive 26 is applied to the web 11 at longitudinally spaced areas by means of the adhesive applying roll unit 28. Additionally, the lines of weakness as at 24 may be introduced into the web 11 by means of a perforating unit 29—or, as is the case with the lines of weakness 30 in the bottom ply 14, these may be introduced into the web roll during the time of printing, i.e., at another place and time from that depicted schematically in FIG. 4.

Figure 2:
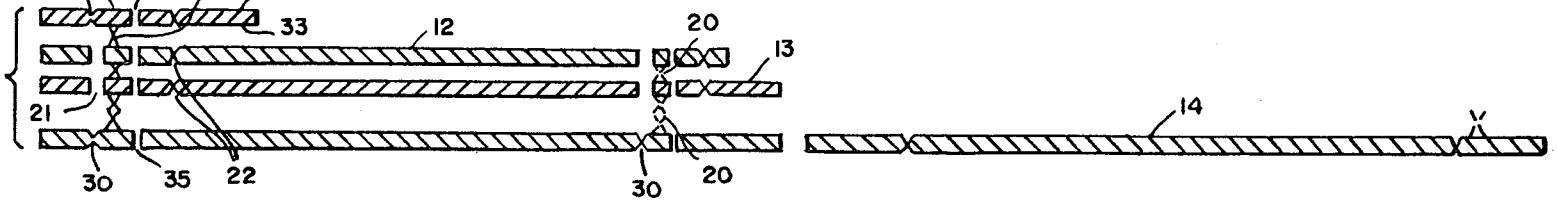
FIG. 2 is a sectional view (enlarged and exploded) taken along the line 2—2 of FIG. 1.

In the use of the form depicted in FIGS. 1 and 2, the upper ply 11 is seen to be wider than the remaining plies to provide feeding margins as at 31. The margins 31 may be equipped with line holes 32 as shown or may be imperforate for engagement with feed wheels (rather than pin belts) and which are responsive to optically sensed registration marks (not shown). Alternatively, the feeding wheels may be positioned closer together and the feed margins 31 omitted. In any event, the continuous business form is fed through a computer printer where relevant information is applied. Normally, the under side 33 of the top ply 11 is equipped with carbon so that the letter impact is transferred through the top ply 11 to the uppermost intermediate ply 12. In like fashion, the intermediate plies 12 are equipped with carbon on their underside so as to transfer the imprint to the next layer therebelow.

After the continuous form has been printed, the form is separated into discrete ticket assemblies—as by bursting along the lines of weakness 24 and 30 (in the top and bottom plies 11 and 14, respectively) as seen in the extreme left hand portion of FIG. 2. Then the person handling the ticket assembly tears off the top ply 11 and discards the same. Thus, if the feed margins 31 are utilized, they are effectively removed from the ticket before the ticket is given to the passenger. Remaining is a packet made up of plies all having the same width and which extend between the transverse cuts 21 in the intermediate plies 12, 13, etc., alternatively the lines of weakness 30 in the bottom ply 14.

From the foregoing, it will be appreciated that as the business form 10 proceeds through the computer, both the top and bottom layers are continuous and only equipped with lines of weakness, not transverse slits. Thus, any possibility of ticket to hang-up or otherwise get caught while proceeding through the computer printer is avoided—all while having only the two exterior plies continuous and all the interior plies completely severed into individual packets of cut sheets so that the problems of tenting or buckling are avoided.

In the practice of the inventive method, the various parent rolls are unwound with the webs issuing therefrom being controlled by pin belts (illustrated schematically as at 34 in the upper central portion of FIG. 4). The pin belts engage the register opening 35 provided in each of the webs 11–14.

Initially, the webs 12, 13, 13*a*, etc., are advanced toward a uniting station which is schematically represented in the central portion of FIG. 4 and designated by the numeral 36. Essentially, the station 36 provides a cutting and uniting function. There the webs 12, 13, 13*a* are united to each other and may be advantageously cut incident to being united with the bottom web 14.

Figure 5:
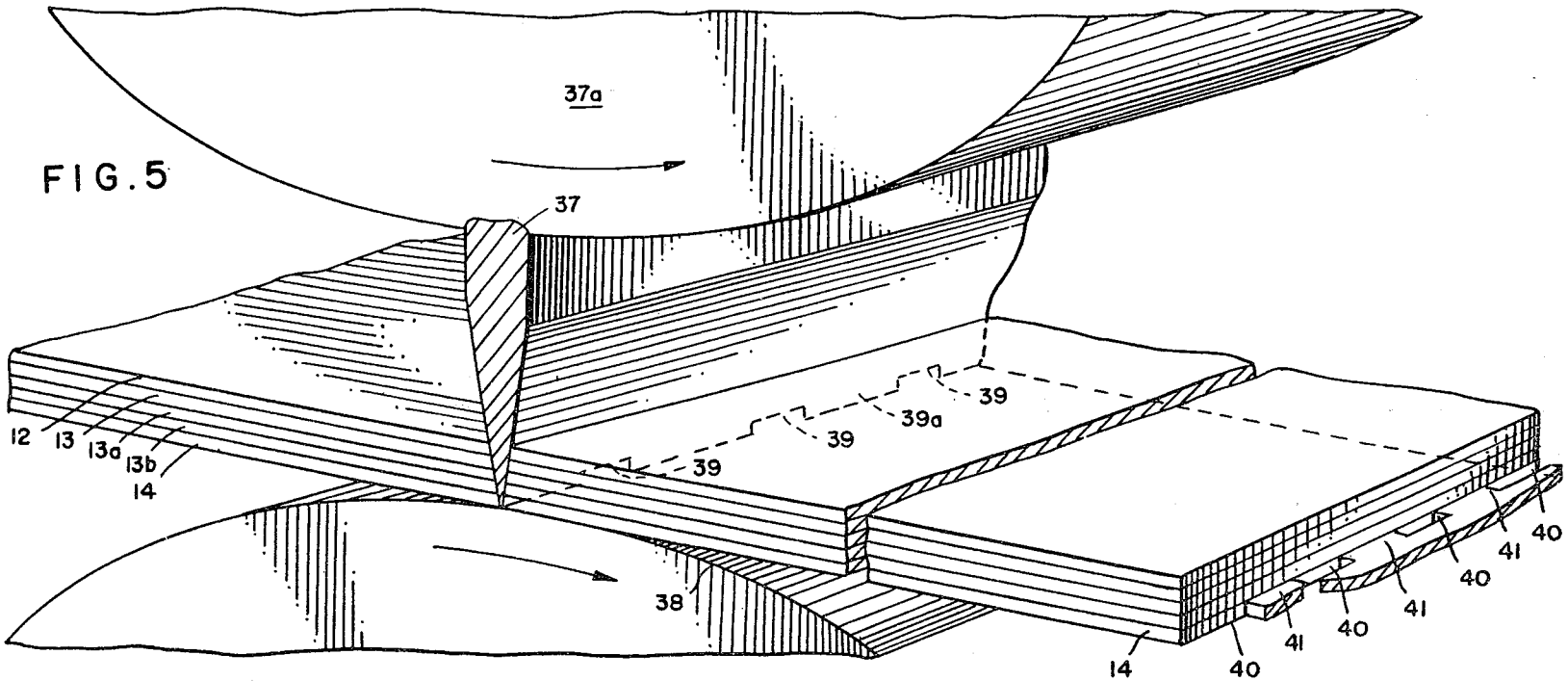
FIG. 5 is an enlarged fragmentary perspective view, partially in section of cutting apparatus employable in the practice of the invention.

In one preferred way of practicing the invention, the webs 12–14 are imperforate and uncut until encountering the station 36. In the station 36, they encounter a rotary knife blade 37 which acts against a hardened impression cylinder or anvil roll 38. As seen in FIG. 5, the blade 37 is operating against interior webs 12, 13, 13*a* and 13*b* as well as the bottom web 14. The knife or blade 37 is recessed or notched at spaced areas across the face of the webs as at 39 which results in the development of transverse slits 40 separated by bonds 41 in the web 14. However, all of the other webs are transversely slit to provide the cuts 21 previously referred to. Thus, I provide an advantageous cutting and perforating function simultaneously within the station 36. However, it will be appreciated that in some instances it may be advantageous to provide the perforating function elsewhere. For example, the invention contemplates the provision of the transverse lines of weakness or perforation 22 in the various intermediate plies as part of the printing operation on paper which ultimaely becomes the various parent rolls 16–18. Therefore, in like fashion, the parent roll 15 can be transversely perforated, i.e., equipped with lines of weakness.

Thus, the notches 39 develop positioning feet 39*a* which bear against the surface of the hardened impression cylinder 38 to establish and maintain the blade in proper position to selectively cut the upper plies and perforate the lower most ply. It will be appreciated that should the perforating of the web 14 be advantageously performed at another point in the processing, the knife 37 can be suitably arranged relative to the surface of the hardened impression cylinder 38 so as only to cut the intermediate plies and not affect the bottom ply 14. Suitable spacing can be provided for this purpose between the cylinder 38 and the cylinder 37*a* which carries the blade 37, such spacer ordinarily being known to the art by the term "bearers."

After the interior plies are cut, the second single web 11 (the first single web being the web 14) is united with the cut interior plies and is so arranged that the line of weakness 24 is aligned with the lines of weakness 30 in the bottom ply 14—and also aligned with the cuts 21 in the various intermediate plies (see the extreme left hand portion of FIG. 4). Thereafter, the now integrated plies are sent through a folding unit 42 to develop the well-known zig-zag stack of business forms 43.

As illustrated, the intermediate plies are equal in length to the exterior plies—by virtue of the lines of weakness 24 and 30 being aligned with the longitudinally spaced lines of cutting 21.

Figure 3:
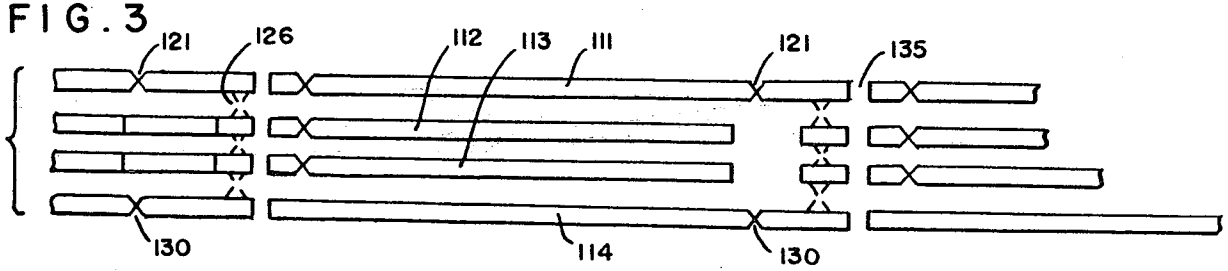
FIG. 3 is a view similar to FIG. 2 but of a modified version of the business form made according to the teachings of the invention.

In some instances, however, it may be advantageous to have the interior plies shorter than the exterior plies, i.e., space the lines of weakness 121 and 130 in the plies 111 and 114, respectively a distance apart greater than the length of the intermediate plies 112 and 113 (see FIG. 3). This may be achieved advantageously through advancing the webs 112 and 113 which ultimately become the intermediate plies at a rate slower than the advancement of the web 14 which becomes the bottom ply—but then performing the steps of cutting and perforating at the same frequency. Alternatively, it is possible to advance the webs 112 and 113 at the same rate as the web 114 and also perform the steps of cutting and perforating at the same frequency but achieve the configuration of FIG. 3 by removing a portion of "chip" from each of the intermediate webs 112 and 113. Other than effectively foreshortening interior plies 112 and 113 in the version seen in FIG. 3, the business form is essentially the same as that described in conjunction with FIGS. 1 and 2. For example, the uppermost or top exterior ply 111 is adhered to the topmost intermediate ply 112 by adhesive as at 126. Likewise, each of the webs or plies have register openings as at 135.

Figure 6:
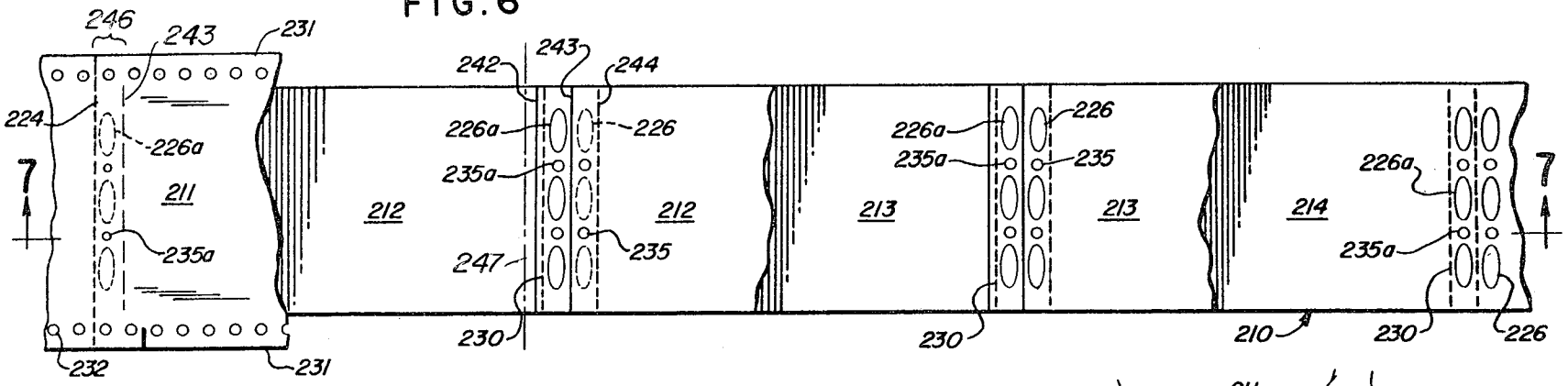
FIG. 6 is a fragmentary top plan view of a modified form of airline ticket.
Figure 7:
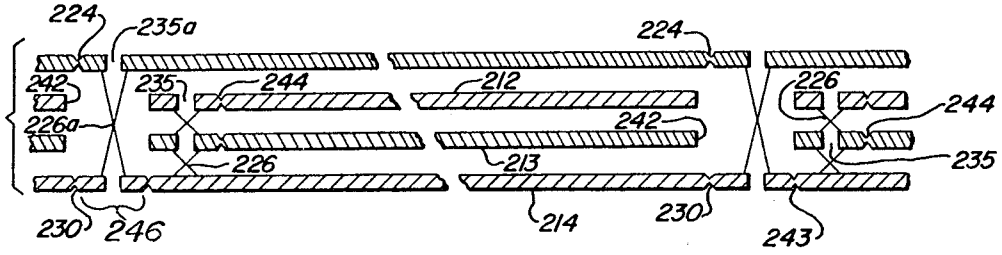
FIG. 7 is a sectional view (enlarged and exploded) taken along the line 7—7 of FIG. 6.

A third embodiment of the invention which is particularly advantageous for quick removal of the unnecessary portions of the ticket is seen on the third drawing sheet and with respect to FIGS. 6–7. Again, like elements are given like numerals but here, with the addition of 200. Thus, the top wider ply is designated 211, the two intermediate plies 212 and 213, and the bottom ply 214.

Again, the top ply 211 has a line of transverse weakness 224 (see the left hand portions of FIGS. 6 and 7) which extends the full width of the top ply 211, including the marginal portions 231. As before, these marginal portions 231 are equipped with line holes 232. Alternatively or cumulatively, the top ply 211 may be equipped with optically-scannable marks as at 231*a* for controlling the movement of the connected series of tickets through the computer printer—in certain cases therefore, the line hole margins 231 may be eliminated.

As can be best appreciated from FIG. 7, the bottom ply 214 is equipped with a similar and aligned line of weakness or perforation 230. Thus, rupturing the continuous ticket assemblies along the aligned perforation lines 224 and 230 results in the removal of a discrete ticket assembly.

The top ply 211 and the bottom ply 214 are connected by means of spaced spots of adhesive as at 226*a*. Intermediate the adhesive spots 226*a* are provided register openings 235*a* (again compare the left hand portions of FIGS. 6 and 7). Thus, the top ply 211 can be advanced in synchronism and registry with the bottom ply 214 and the intermediate plies 212 and 213, the structure and relationship of which will now be described.

The intermediate plies 212 and 213 are unconnected to the top ply 211 but are connected to each other and to the bottom ply 214 by means of spots of adhesive 226. Intermediate the spots of adhesive 226 are provided register openings 235 which extend through the plies 212–213 but not through the plies 212 and 214. As will be brought out hereinafter relative to FIG. 8, the top and bottom plies 212 and 214 have aligned register openings 235*a*.

Advantageously, the plies 212 and 213 terminate short of the aligned lines of severance 224, 230 so as to facilitate zig-zag folding, i.e., the trailing or second ends 242 of the intermediate plies 212 and 213 are spaced from the lines 224, 230 so that they do not intrude into the fold area. Optimally, this is of the order of about 1–3 mm. (1/32" to $\frac{1}{8}$").

At their first or leading ends 245 (i.e., away from the ends 242) the intermediate plies 212 and 213 terminate considerably shorter of the aligned lines of severance 224, 230 being aligned with a second line of weakness 243 in the bottom ply 214. As will be brought out hereinafter, this facilitates detachment of the computer printed portion of the ticket packet from the top ply, i.e., the narrower portion from the wider ply as illustrated.

Each intermediate ply 212, 213, etc. is equipped with a line of perforation or severance spaced from the ends 245—as at 244—to permit detachment of individual plies or tickets from a pack which, as illustrated, includes the plies 212–214.

Figure 10:
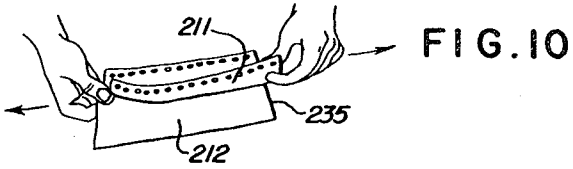
FIG. 10 is a fragmentary perspective view showing the novel action in separating a portion of the ticket from the overall form.

To develop this subpack consisting of the plies 212–214, the operation depicted in FIG. 10 is followed where the end portion 246 containing the adhesive spots 226a is grasped by the fingers and thumb of one hand and the subpack consisting of plies 212–214 is grasped along the plane 247 by the other. Then with a "bursting" or snap-apart motion, the subpack of the plies 212–214 can be detached. The intermediate plies are, of course, unconnected to the top ply while the bottom ply 214 is equipped with a second line of transverse severance as at 243 which is aligned with the ends 245 of the intermediate plies. Thus, a discrete ticket packet where all plies are of the same width (as illustrated) can be derived from the detached ticket assembly.

Figure 8:
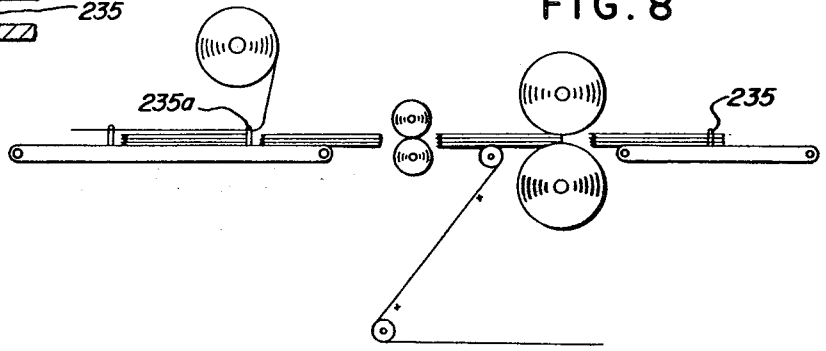
FIG. 8 is a schematic elevational view of apparatus for practicing the invention.

The method of producing the form of FIGS. 6–7 can be appreciated from a consideration of FIG. 8 wherein apparatus is schematically represented for practicing the invention.

At the upper left hand portion of FIG. 8, a parent roll 248 is seen to be in the process of being unwound so as to provide the top ply 211. As indicated previously, the top ply 211 may or may not be equipped with the line hole margins 231. In some computer printers, the connected series of tickets are advanced by pressure rollers which are operated, i.e., controlled, by optically scanned marks such as is indicated in FIG. 6 at 231a. It will be apparent that the marks 231a which are provided at longitudinally spaced apart positions may be located at various locations across the width of the form.

The bottom web or ply 214 is seen at the bottom center portion of FIG. 8 and passes around idler rollers 249 and 250 so as to enter into a predetermined generally lineal path of web ply assembly. Thus, at the extreme left hand portion of FIG. 8 the bottommost ply is 214 while the uppermost ply is 211, there being illustrated two interior plies 212 and 213.

The interior plies are seen in the path P at the right hand portion of FIG. 8, having been unwound from parent roll sources of the type illustrated with respect to FIG. 4. The interior plies 212 and 213 are advanced on a pin belt conveyor 251 which is equipped with projecting pins for entry into the longitudinally spaced apart openings 235. At this juncture, the interior plies 212 and 213 (which, in the illustration given, become the interior plies of a ticket packet) are continuous in nature, i.e., being of indefinite length. Advantageously, however, the interior or intermediate plies are previously equipped with equally longitudinally spaced apart lines of perforation 244 as well as the register openings 235, along with the printing normally associated with forms such as airline tickets.

The pins 252 on the pin belt conveyor 251 advance the continuous interior plies 212, 213 toward a cutoff station consisting of cutoff rolls 253 and 254. These may be conventional rolls equipped with a cutting knife and anvil surface as illustrated so as to transversely sever the continuous interior plies along equally longitudinally spaced apart transverse lines. For conventional, presently employed airline tickets, the interior packets have a length of 8". Thus, the longitudinal spacing of the transverse lines of severance of the interior plies is on 8" centers.

As the leading edge 245 issues from the nip between the cutoff rolls 253 and 254 it may be advantageously supported on a table surface 255 prior to engagement with the bottom web 214 passing around the idler roll 250. The bottom web 214 is equipped with longitudinally spaced apart spots of adhesive as at 226 from an adhesive applying roll 256. Previously, the interior plies 212, 213, etc., have been united by the upper spots of adhesive 226 as seen in FIG. 7.

The transverse aligned adhesive spots 226 applied to the bottom web 214 are aligned with the previously applied spots of adhesive 226 uniting the interior plies. Union is completed when the webs 212–214 pass through the uniting rolls 257 and 258 which press the intermediate and bottom plies together. In the illustration given, the axial spacing between the cutoff rolls 253, 254 and the uniting rolls 257, 258 is slightly less than the cutoff length, i.e., about $7\frac{7}{8}$". Thus, just prior to cutoff, the leading edge portion just rearward of the leading edge 245 is entering the nip between the uniting rolls 257 and 258. Thus, with a cutoff length of 8" for the interior plies 212, 213, $\frac{1}{8}$" of the packet is in the nip at the time of cutoff—so the interior webs are under control at the time of cutoff. It will be appreciated that the web 214 is traveling somewhat faster than the speed of advance of the intermediate plies 212, 213 in view of the fact that the cutoff length, i.e., ticket length of the intermediate plies is 8" while that of the bottom ply 214 is $8\frac{1}{2}$". The uniting rolls are traveling at the faster rate and thereby effect a separation between successive interior ply packets as is illustrated in the left hand portion of FIG. 8, i.e., downstream of the uniting rolls 257, 258.

As the bottom ply 214 issues from the nip between the uniting rolls 257, 258, the register openings 235a therein are engaged by pins 259 on the downstream pin belt conveyor 260. It will be appreciated that the bottom web 214 is continuous so that it is completely under control throughout the operation, having been threaded onto the pins 259. Thereafter, the top web 211 passes around idler roll 261 and is also engaged by te pins 259 which extend through the register openings 235 in the top web 211. The under or bottom facing side of the web 211 is advantageously equipped (by means not shown) with adhesive dots 226a so as to effect a union between the top and bottom webs 211, 214 in the longitudinal spaces between adjacent intermediate ply packets. Both the webs 211 and 214 are advantageously equipped with the transverse lines of weakening 224, 230 and 243 prior to entry into the path P.

Figure 9:
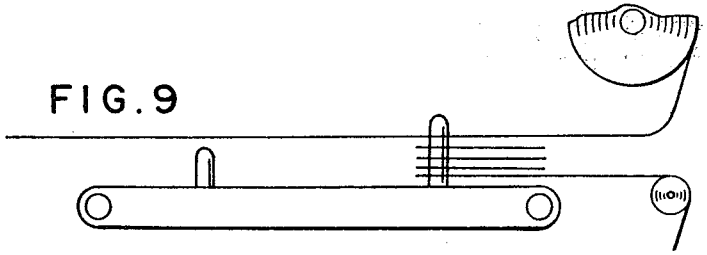
FIG. 9 is a view similar to FIG. 8 but showing a variation thereof.

In some instances it may be advantageous to employ the same register openings in all of the plies for the purpose of union and this is illustrated in FIG. 9. In FIG. 9, the top web 311 is derived from a parent roll 348 and is equipped with register openings 335a aligned with the register openings 335 in the intermediate plies and the register opening 335a in the bottom ply 314. However, the arrangement of FIGS. 6–8 is preferred because there the pins 259 have only to pass through two aligned openings as contrasted to five—a more difficult task.

In any event, the invention provides for a reliable, controlled system for introducing shorter packets of interior plies into a form whereby it is possible to space the trailing ends of the interior plies 242 a slight distance downstream of the transverse lines of weakness 230 in the bottom or carrier ply. This avoids the problems of tenting and the like referred to hereinbefore. In some instances, it is also advantageous to eliminate the top web 211 so that the uppermost so-called interior ply 212 thereby becomes the uppermost web in the final ticket assembly.

While in the foregoing specification, a detailed description of the invention has been set down for the purpose of illustration, many variations in the details hereingiven may be made by those skilled in the art without departing from the spirit and scope of the invention.

I claim:

1. A method of making a form suitable for airline ticketing and the like comprising advancing a plurality of superposed webs in a predetermined path, said ply plurality ultimately becoming at least a part of the interior plies of said form, sequentially severing said ply plurality along equally longitudinally spaced apart transverse lines to provide a sequence of packets, introducing a bottom ply into said path at a speed greater than the speed of advance of said ply plurality and uniting said ply plurality to said bottom ply to provide a continuous form wherein packets of said plurality of plies are positioned in longitudinally spaced apart relation on said bottom ply, and thereafter zig-zag folding said bottom ply between at least some of the adjacent packets.

2. The method of claim 1 in which said folding is performed along transverse lines spaced about 1–3 mm. from the end of a packet.

3. The method of claim 1 in which a top web is introduced into said path prior to said folding and subsequent to said uniting and united to said bottom web between adjacent packets.

4. The method of claim 1 in which said bottom ply is equipped with a transverse line of weakness between packets and positioned about 1–3 mm. from the corresponding end of each packet, said zig-zag folding occurring along some of said lines of weakness.

5. The method of claim 1 in which said uniting includes introducing said bottom web and the leading edge of said ply plurality into a nip just prior to the occurrence of a subsequent transverse severance.

6. The method of claim 5 in which a top web is introduced into said path subsequent to said uniting and united to said bottom ply between adjacent packets.

7. The method of claim 6 in which said ply plurality is equipped with longitudinally spaced apart register openings positioned just rearward of said transverse lines of severance for advancing the same toward means for transversely severing said ply plurality, said bottom ply also being equipped with longitudinally spaced apart register openings longitudinally spaced apart a distance greater than the register openings in said ply plurality.

8. The method of claim 7 in which said bottom ply register openings are positioned between said packets.

9. The method of claim 7 in which said bottom ply register openings are aligned with the register openings in said packets.

* * * * *